US007982151B2

(12) United States Patent
Villain et al.

(10) Patent No.: US 7,982,151 B2
(45) Date of Patent: Jul. 19, 2011

(54) ELECTRICAL SWITCH WITH LATERAL OPERATION AND ASSEMBLY COMPRISING SUCH A SWITCH MOUNTED ON A PLATE

(75) Inventors: Jean-Christophe Villain, Dole (FR); Michel Cour, Sampans (FR)

(73) Assignee: CoActive Technologies LLC, Newton, MA (US)

( * ) Notice: Subject to any disclaimer, the term of this patent is extended or adjusted under 35 U.S.C. 154(b) by 399 days.

(21) Appl. No.: 12/329,962

(22) Filed: Dec. 8, 2008

(65) Prior Publication Data

US 2009/0145736 A1 Jun. 11, 2009

(30) Foreign Application Priority Data

Dec. 6, 2007 (FR) ..... 07 59613

(51) Int. Cl.
*H01H 5/18* (2006.01)

(52) U.S. Cl. ..... 200/406

(58) Field of Classification Search ..... 200/16 R–16 D, 200/405–409, 447, 449, 453, 520, 522, 517, 200/341, 533, 551, 275, 547, 549, 550
See application file for complete search history.

(56) References Cited

U.S. PATENT DOCUMENTS

| | | | | |
|---|---|---|---|---|
| 4,153,829 | A * | 5/1979 | Murata | 200/533 |
| 4,563,555 | A | 1/1986 | Ohtani | |
| 6,114,644 | A * | 9/2000 | Nishikawa | 200/406 |
| 6,392,177 | B1 * | 5/2002 | Zhang et al. | 200/406 |
| 7,741,573 | B2 * | 6/2010 | Masuda et al. | 200/406 |
| 2006/0037851 | A1 | 2/2006 | Hu et al. | |

FOREIGN PATENT DOCUMENTS

| | | |
|---|---|---|
| DE | 2706463 A1 | 8/1977 |
| EP | 1113472 A | 7/2001 |
| EP | 1414053 A | 4/2004 |
| EP | 0224006 A | 6/2008 |

* cited by examiner

*Primary Examiner* — Edwin A. Leon
(74) *Attorney, Agent, or Firm* — Pepper Hamilton LLP

(57) ABSTRACT

An electrical switch may include a support bearing contacts, at least one elastically deformable release element for establishing an electrical connection between two contacts, an actuation pusher that is configured to be movable relative to the support along an overall horizontal path in the plane of the plate bearing electronic components and a lever that is configured to be mounted in a hinged manner relative to the support about a horizontal axis and which converts the horizontal actuation force exerted on the pusher into a vertical release force applied to the release element. The lever may be elastically deformable to allow a movement of the pusher beyond the actuation position.

16 Claims, 7 Drawing Sheets

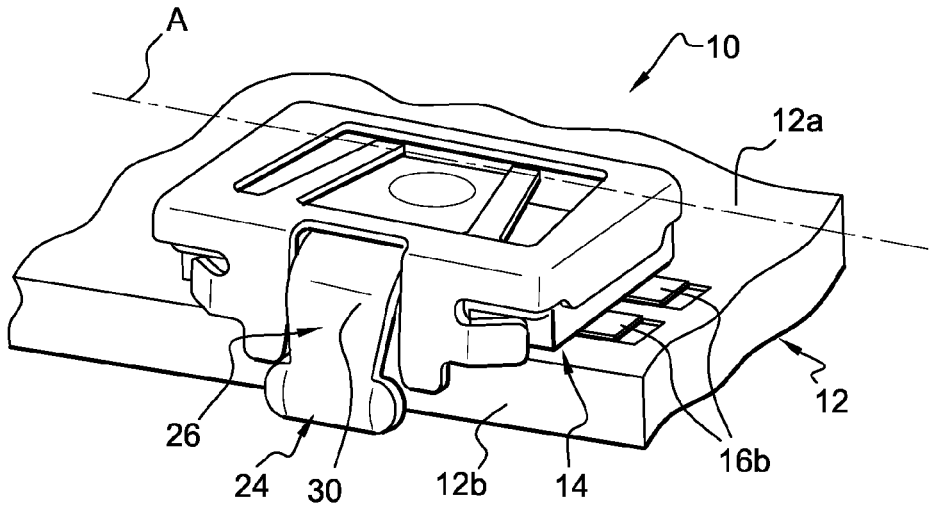
Fig. 1
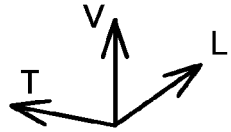
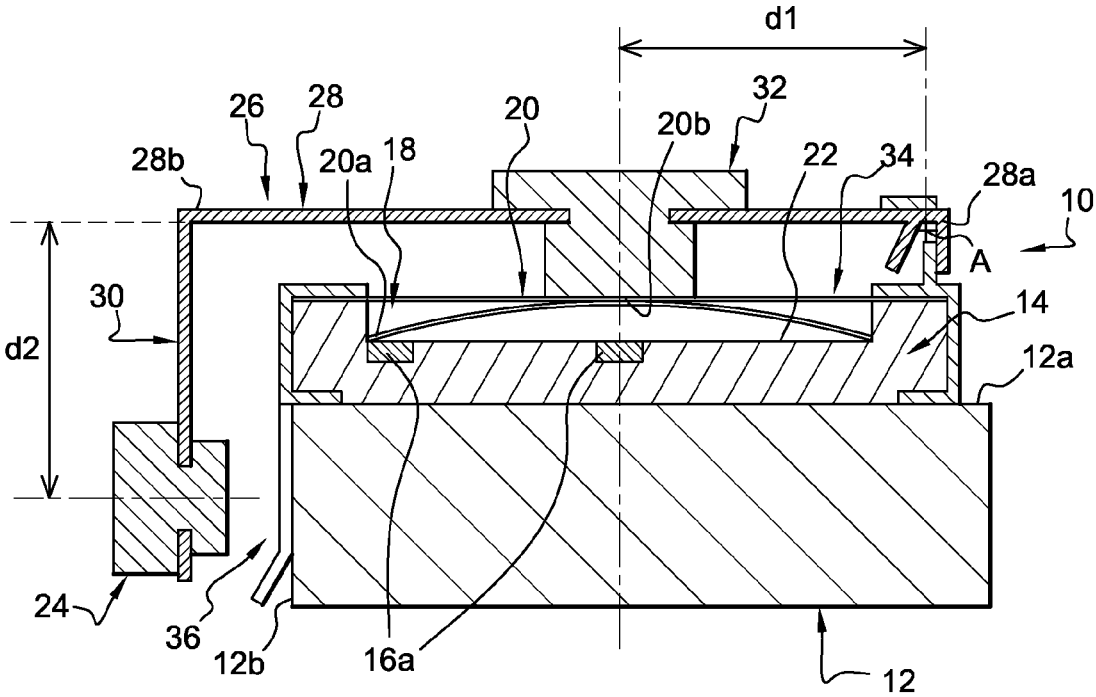
Fig. 3
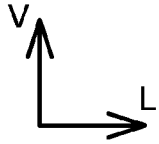

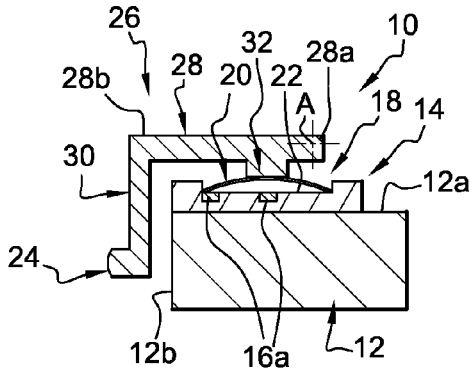
Fig. 7A
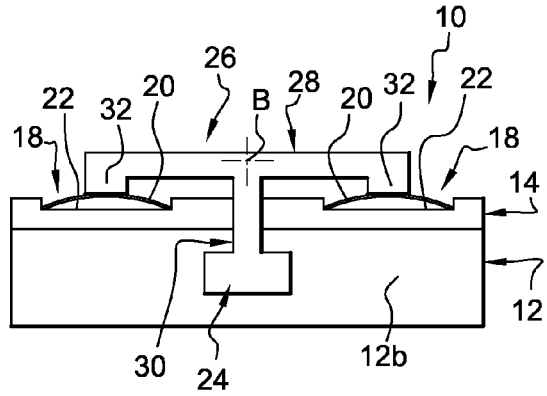
Fig. 7B
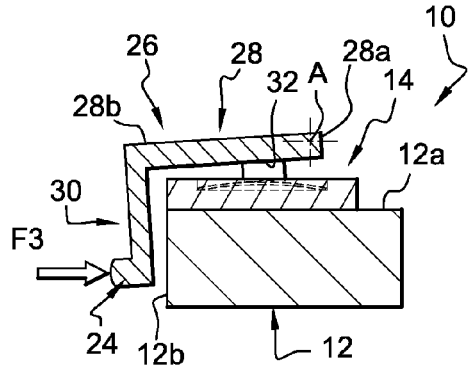
Fig. 8A
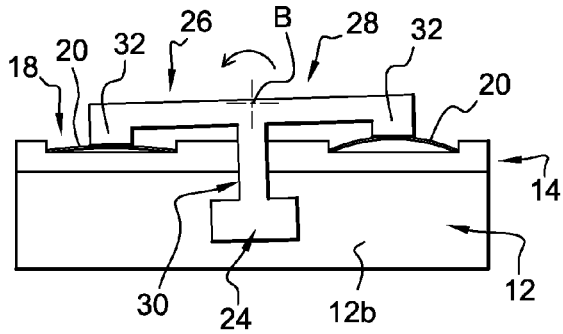
Fig. 8B
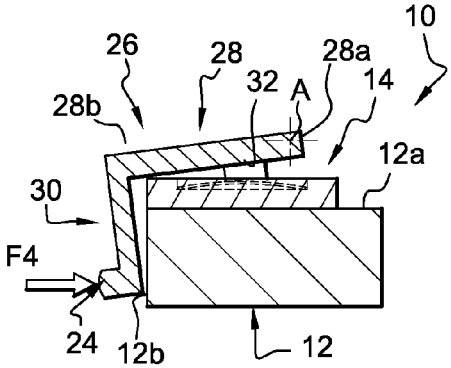
Fig. 9A
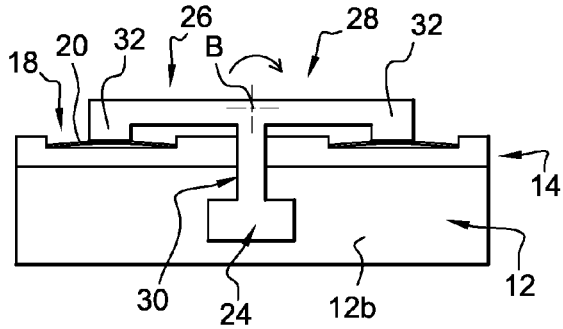
Fig. 9B
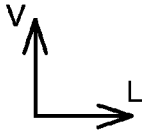
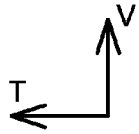

ELECTRICAL SWITCH WITH LATERAL OPERATION AND ASSEMBLY COMPRISING SUCH A SWITCH MOUNTED ON A PLATE

CROSS-REFERENCE TO RELATED APPLICATION

This application claims the benefit of priority to French Patent Application No. 0759613, filed Dec. 6, 2007, which is hereby incorporated by reference in its entirety.

BACKGROUND

U.S. Pat. No. 4,563,555 describes a switch comprising an actuation pusher that is movable in the horizontal plane of the component-bearing plate and which actuates a release element mounted on an upper face of the component-bearing plate. The switch also comprises a lever that is mounted in a hinged manner relative to the component-bearing plate which converts the horizontal action on the pusher into a vertical action on the release element. According to that document, when the pusher receives a large-amplitude action, for example in the case of an impact, all the action is transferred to the release element, which risks badly damaging the release element.

SUMMARY

An electrical switch may include an actuation pusher that may be movable in the plane of the plate bearing electronic components on which the switch is mounted. More particularly, an electrical switch may include a support bearing contact that can be mounted on an upper horizontal face of a horizontal plate bearing electronic components and may be configured to define a housing in the base of which at least two fixed electrical contacts are located. At least one generally dome-shaped release element may be accommodated in the housing of the support and may be configured to be elastically deformable from a rest position for establishing an electrical connection between the two fixed contacts. An actuation pusher may be configured to be movable relative to the support along an overall horizontal path in the plane of the plate bearing electronic components from a rest position associated with the rest position of the release element to an actuation position of the release element. A lever may be mounted in a hinged manner relative to the support about a horizontal axis and may convert the horizontal actuation force exerted on the pusher into a vertical release force applied to the release element.

Such a switch may be used, for example, in a portable electronic device such as a mobile telephone and may be mounted on a side wall of the device. The switch may be configured to be actuated with an action perpendicular to the wall, i.e. in a direction different from the direction of actuation of the buttons of the numeric keypad of a telephone.

The movement of the actuation pusher in the plane of the component-bearing plate may allow the forces to be guided directly towards the component-bearing plate, hence avoiding the risks of detaching the switch from the component-bearing plate.

An electrical switch with lateral operation may allow the forces undergone by the release element to be limited in the event of a large-amplitude action on the actuation pusher.

An electrical switch may include a lever that may be configured to be elastically deformable to allow a movement of the pusher beyond the actuation position to a position for which at least part of the actuation force is not transferred to the release element when the value of the actuation force is greater than a threshold value.

In an embodiment, the lever may be configured to deform elastically to allow a movement of the pusher through to a stop position against a facing edge of the plate bearing electronic components. The release element may form a releasable stop of the lever pivoting about the horizontal axis, which may be configured to change state when the amplitude of the actuation force is greater than a predefined value. The threshold value of the actuation force causing deformation of the lever may be greater than the predefined value causing the change in state of the release element. The switch can be mounted close to a rear longitudinal end edge of the component-bearing plate. The lever may include a vertical wing that may be arranged longitudinally behind the rear edge of the component-bearing plate, the lower end of which may be connected to the pusher, and may include a horizontal wing that may extend longitudinally forwards from an upper end of the vertical wing such that it is positioned above the release element, and the front longitudinal end of which may be hinged in relation to the support about at least one transverse hinge axis. The horizontal wing may bear an actuator that presses downwards against the release element. The longitudinal distance between the actuator and the transverse hinge axis may be approximately equal to the vertical distance between the pusher and the transverse hinge axis. The switch may include two release elements distributed on either side of a median longitudinal axis of the support, each of which may be associated with two electrical contacts. The release elements can be selectively actuated depending on the amplitude of the horizontal actuation force exerted on the pusher. The lever may be configured to pivot about a longitudinal axis to enable selective actuation of the release elements. The switch may include a slide that is mounted so as to slide longitudinally relative to the support and the horizontal actuation force may be exerted on the pusher.

In an embodiment, an assembly may include a component-bearing plate and a switch which may be mounted close to a rear longitudinal end edge of the plate.

BRIEF DESCRIPTION OF THE DRAWINGS

Aspects, features, benefits and advantages of the embodiments described herein will be apparent with regard to the following description, appended claims, and accompanying drawings where:

FIG. 1 depicts a schematic perspective representation of an electrical switch according to an embodiment.

FIG. 3 depicts a schematic representation of a cross section in a vertical longitudinal plane of the electrical switch represented in FIG. 1 according to an embodiment.

FIG. 7A depicts a cross section in a vertical longitudinal plane of the switch represented in FIG. 6 according to an embodiment.

FIG. 7B depicts a view in a vertical transverse plane of the switch represented in FIG. 7A according to an embodiment.

FIGS. 8A and 8B depict views similar to the views of FIGS. 7A and 7B, showing the switch according to the invention for which a first release element is actuated according to an embodiment.

FIGS. 9A and 9B depict views similar to the views of FIGS. 7A and 7B, showing the switch for which both release elements are actuated according to an embodiment.

DETAILED DESCRIPTION

Figure 2:
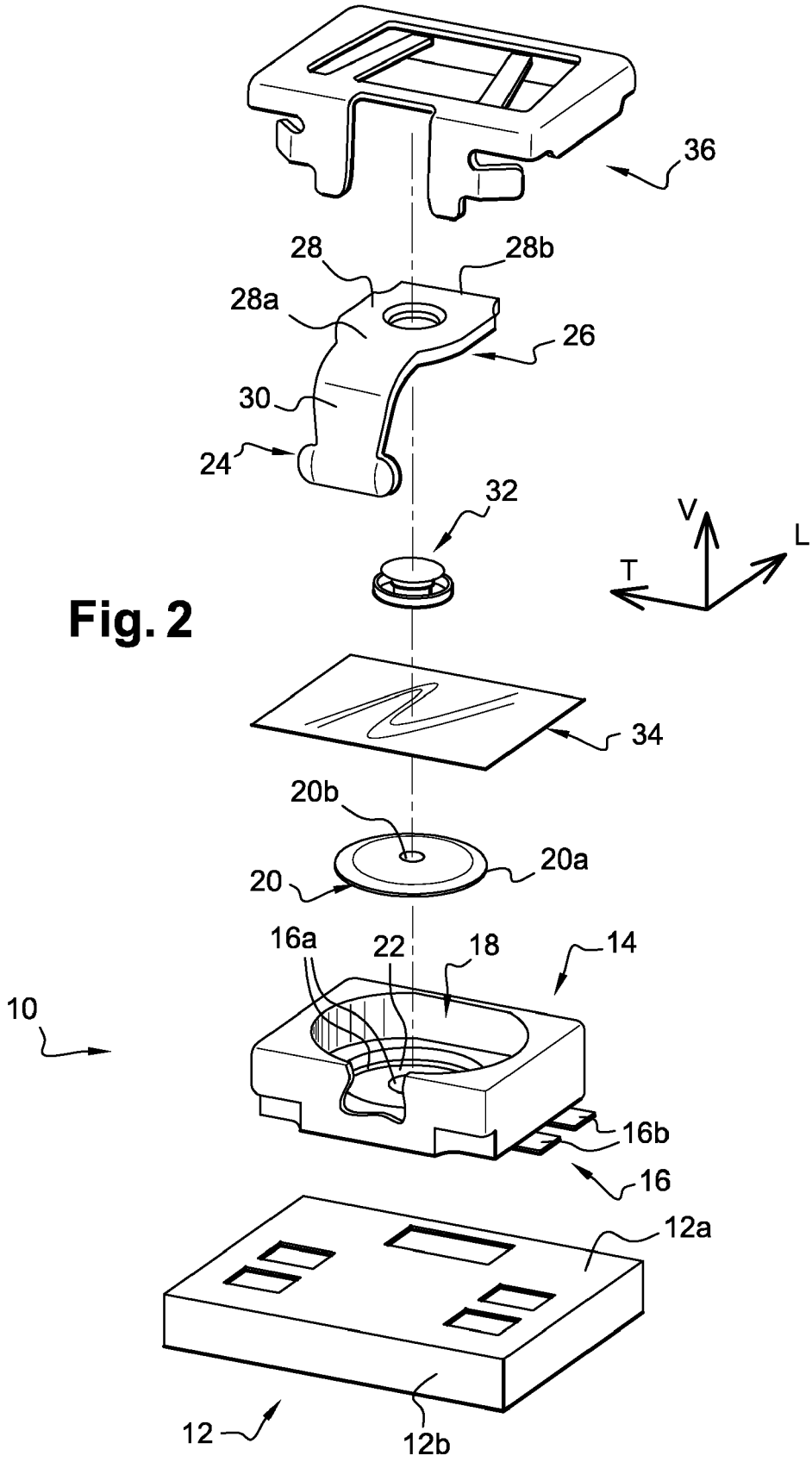
FIG. 2 depicts a schematic exploded perspective representation of the electrical switch represented in FIG. 1 according to an embodiment.

Before the present methods are described, it is to be understood that this invention is not limited to the particular systems, methodologies or protocols described, as these may vary. It is also to be understood that the terminology used herein is for the purpose of describing particular embodiments only and is not intended to limit the scope of the present disclosure which will be limited only by the appended claims.

As used herein and in the appended claims, the singular forms "a," "an," and "the" include the plural reference unless the context clearly dictates otherwise. Thus, for example, reference to a "document" is a reference to one or more documents and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

As used herein, the use of the terms "vertical (V)," "longitudinal (L)," "transversal (T)," "front," "rear," "Right," "left," "top" and "bottom" are non-limiting and without reference to the earth's gravity and the elements may be depicted in any configuration. Additionally, identical, similar or analogous elements will be designated by the same reference numerals.

FIGS. 1-12 represent an electrical switch 10 that may be mounted on an upper horizontal face 12*a* of a component-bearing plate 12. The component-bearing plate 12 may be, for example, a printed circuit board. The switch 10 may include a support 14 where the switch 10 may be mounted on the component-bearing plate 12 and in which electrical contacts 16 may be positioned.

As can be seen in FIG. 2, the support 14 may define a recessed housing 18 that may open upwards in which the electrical contacts 16 may be positioned and which may be configured to accommodate a release element 20. Each electrical contact 16 may include a cut and folded metal tongue that runs across the support 14 such that a first end 16*a* of each contact 16 may be situated in the base 22 of the recessed housing 18 and a second end 16*b* may be situated outside the support 14 and may be in contact with the upper face 12*a* of the component-bearing plate 12.

As can be seen in FIG. 2, the base 22 of the recessed housing 18 may be circular in shape, and the first end 16*a* of an electrical contact 16 may be annular in shape and may be situated at the periphery of the base 22. The first end 16*a* of the other electrical contact 16 may be situated at the centre of the base 22. The upper face 12*a* of the component-bearing plate 12 may include an electrical track (not represented) that may be connected to each second end 16*b* of an electrical contact, for example by soldering or brazing.

The release element 20 may be a component configured to electrically connect the two electrical contacts 16 when the switch 10 is actuated. The release element 20 may include a circular dome, domed upwards, that is made of electrically conductive material and which may be configured to be elastically deformable to come into simultaneous contact with the first end 16*a* of the two electrical contacts 16. The peripheral edge 20*a* of the release element 20 may be in permanent contact with the first end 16*a* of the electrical contact 16, which may be annular in shape, and the central portion 20*b* of the release element 20 may be positioned vertically above and at a distance from the first end 16*a* of the other electrical contact 16.

When the release element 20 is deformed, the central portion 20*b* of the release element 20 may move downwards to come into contact with the first end 16*a* of the associated electrical contact 16. The release element 20 may be in simultaneous contact with both the electrical contacts 16. The release element 20 may be configured to be deformable in the vertical direction (V) perpendicular to the plane of the component-bearing plate 12.

The switch 10 may include an actuation pusher 24 that may be configured to be movable relative to the support 14 under the action of a user to cause deformation of the release element 20. The switch 10 may be intended to be mounted at an edge 12*b* of the component-bearing plate 12 which may be mounted close to a cover element of the electronic device in which the switch is located. The switch 10 may be produced to be actuated in a direction parallel to the plane of the component-bearing plate 12. The actuation pusher 24 may be mounted so as to be movable relative to the support entirely in the plane of the component-bearing plate 12, in the longitudinal direction L, i.e. the actuation pusher 24 may cover an entirely straight path below the support 14.

The action of a user on the switch 10 may include an action on the pusher 24 directed towards the component-bearing plate 12 so as to bring the pusher 24 closer to the edge 12*b* of the component-bearing plate 12, from a rest position in which the pusher 24 is situated a distance from the edge 12*b* of the component-bearing plate 12. In this way, the forces undergone by the switch 10 may be directed in the direction of the component-bearing plate 12, which may limit the risks of detaching the switch 10 from the component-bearing plate 12.

As mentioned above, the release element 20 may be configured to be deformable in the vertical direction (V) and the pusher 24 may be movable in the longitudinal direction (L). To convert the action in the longitudinal direction (L) exerted by a user on the pusher 24 into an action in the vertical direction (V) on the release element 20, the switch 10 may include a lever 26 that may be mounted in a hinged manner relative to the support 14 entirely about a transverse axis A.

The lever 26 may include a metal tongue with a 90° fold. The lever 26 may include a horizontal upper wing 28 which may extend above the release element 20 and which may be connected to the support 14 at its front end 28*b*. The lever may include a rear wing 30 that may extend vertically downwards from one end of the upper wing 28, the rear end 28*a* of the upper wing 28, and on the lower end of which the pusher 24 may be mounted. The lever 26 may be mounted in a hinged manner relative to the support 14 about a transverse axis A which may be situated longitudinally in front of the release element 20 and which may be vertically raised relative to the release element 20. When the user acts on the pusher, the upper wing 28 of the lever 26 as a whole may rock downwards. The upper wing 28 may extend above the release element 20. The upper wing 28 may carry an intermediate actuator 32 that may be in direct contact with the central portion 20*b* of the release element 20, which has the function of conveying the forces between the lever 26 and the release element 20.

An intermediate protection film 34 may be located at the upper opening of the housing 18 to seal the housing 18 and protect the contacts 16 and the release element 20 against dust and moisture.

Figure 4:
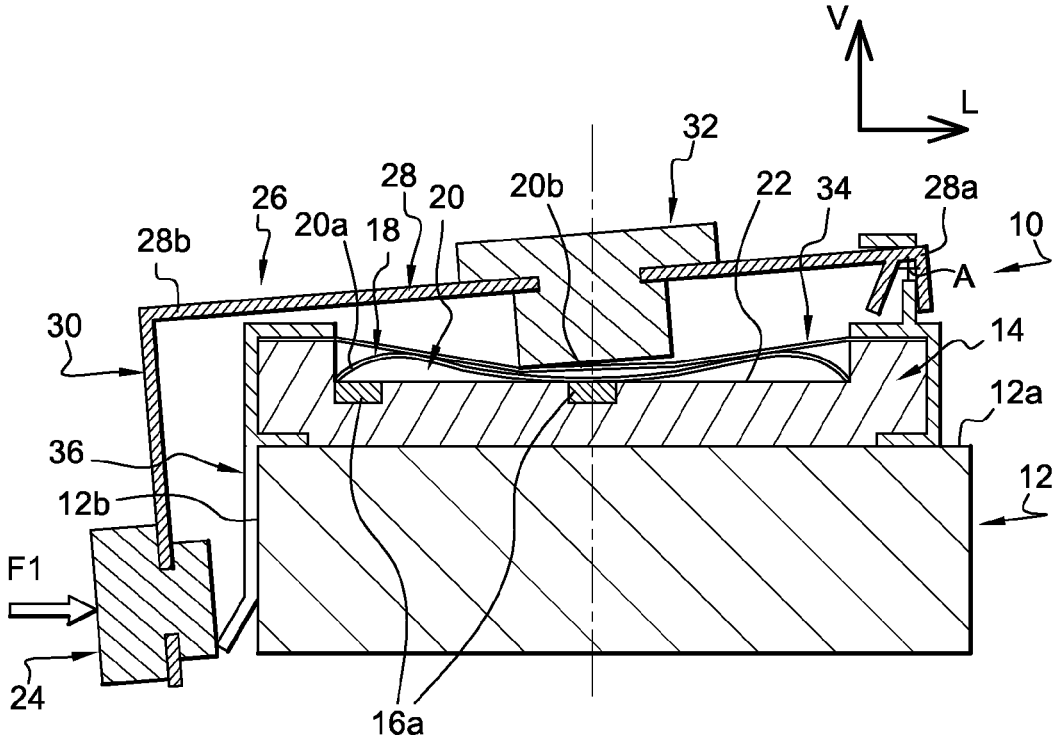
FIG. 4 depicts a view similar to that of FIG. 3 in which the actuation pusher is subjected to a switch actuation force according to an embodiment.

The switch 10 may include a frame 36 for holding the support on the component-bearing plate 12 which may be made, for example, of a current conducting material and the support 14 may be fixed to the component-bearing plate 12. The frame 36 may allow components of the switch 10 to be protected against possible mechanical shocks. FIGS. 3 and 4 represent two states of the switch 10.

In FIG. 3, the switch 10 may be in the rest position, i.e. the pusher 24 may not be being subjected to any action. In the rest position of the switch 10, the pusher 24 may be positioned longitudinally a certain distance from the edge 12*b* of the component-bearing plate 12. The lever 26 may be directed relative to the support such that its upper wing 28 may be horizontal and its rear wing 30 may be vertical. In this rest position, the central portion 20*b* of the release element 20 may be positioned vertically a distance from the end 16*a* of the associated electrical contact 16.

In FIG. 4, the switch 10 may be in an actuation position for which a user may exert a generally horizontal command action in the forward direction on the pusher 24, which is represented by the arrow F1. This command action may cause the lever 26 to rock downwards about its transverse pivot axis A.

The pusher 24 may move towards an actuation position in which it has become closer to the edge 12*b* of the component-bearing plate 12 in relation to its rest position. The horizontal wing 28 of the lever 26 then may pivot downwards, simultaneously driving the actuator 32 to cause the elastic deformation of the release element 20 in order that its central portion 20*b* comes into contact with the first end 16*a* of the electrical contact 16 associated with it. The release element 20 may be in simultaneous contact with the two electrical contacts 16 and the switching channel associated with the electrical contacts 16 may be established.

The release element 20 may be an elastically deformable element that is configured to reassume its initial shape, represented in FIG. 3, when it is not being subjected to any action. The release element 20 may exert an upwardly directed return force on the actuator 32, and hence on the lever 26.

When the user stops acting on the pusher 24, the lever 26 may be elastically returned to its rest position, represented in FIG. 3, by the release element 20. Such an embodiment of the release element may allow a reduction in the number of parts of the switch 10, which may not include an additional part effecting the elastic return of the lever 26.

According to an embodiment, the release element 20 may form a releasable stop of the actuator in the high rest position, which may be configured to change state when the amplitude of the command action exerted by the user on the pusher 24 is greater than a threshold amplitude. During the change in state of the release element 20, the element may deform rapidly. The assembly formed by the pusher 24, the lever 26 and the actuator 32 may simultaneously rock downwards and the force resisting the command action may be abruptly cancelled. The rapid movement of the pusher 24 and the abrupt variation in forces may be sensed by the user, which may confirm to the user that the switch 10 has been actuated.

Figure 5:
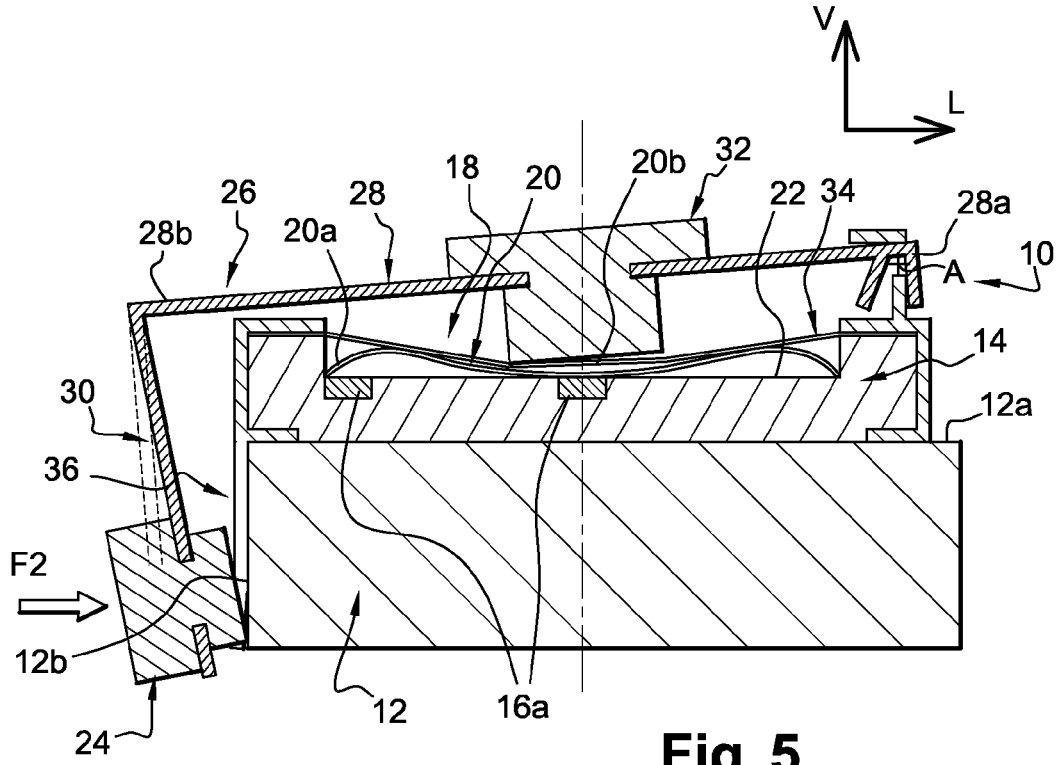
FIG. 5 depicts a view similar to that of FIGS. 3 and 4, showing the switch when the actuation pusher is subjected to a large force according to an embodiment.

However, the amplitude of the force exerted on the pusher 24 may be sometimes markedly greater than the threshold amplitude causing deformation of the release element 20. The very high amplitude force may be exerted by the user in the event of an impact. When such a very high amplitude force is transmitted in its entirety to the release element 20 by the pusher 24, the lever 26 and the actuator 32, this force may damage the release element 20. For this reason, according to the invention, and as can be seen in FIG. 5, the lever 26 may be elastically deformable to allow the pusher 24 to move beyond its actuation position through to a stop position against the facing edge 12*b* of the component-bearing plate 12 when a generally horizontal command action in the forward direction and of high amplitude, represented by the arrow F2, is exerted on the pusher 24.

In the stop position only part of the forces undergone by the pusher 24 may be transmitted to the release element 20. The remainder of the forces undergone by the pusher 24 may be transmitted directly to the component-bearing plate 12. Hence, the risks of damaging the release element 20 may be limited, which may improve the lifetime of the switch 10.

Figure 6:
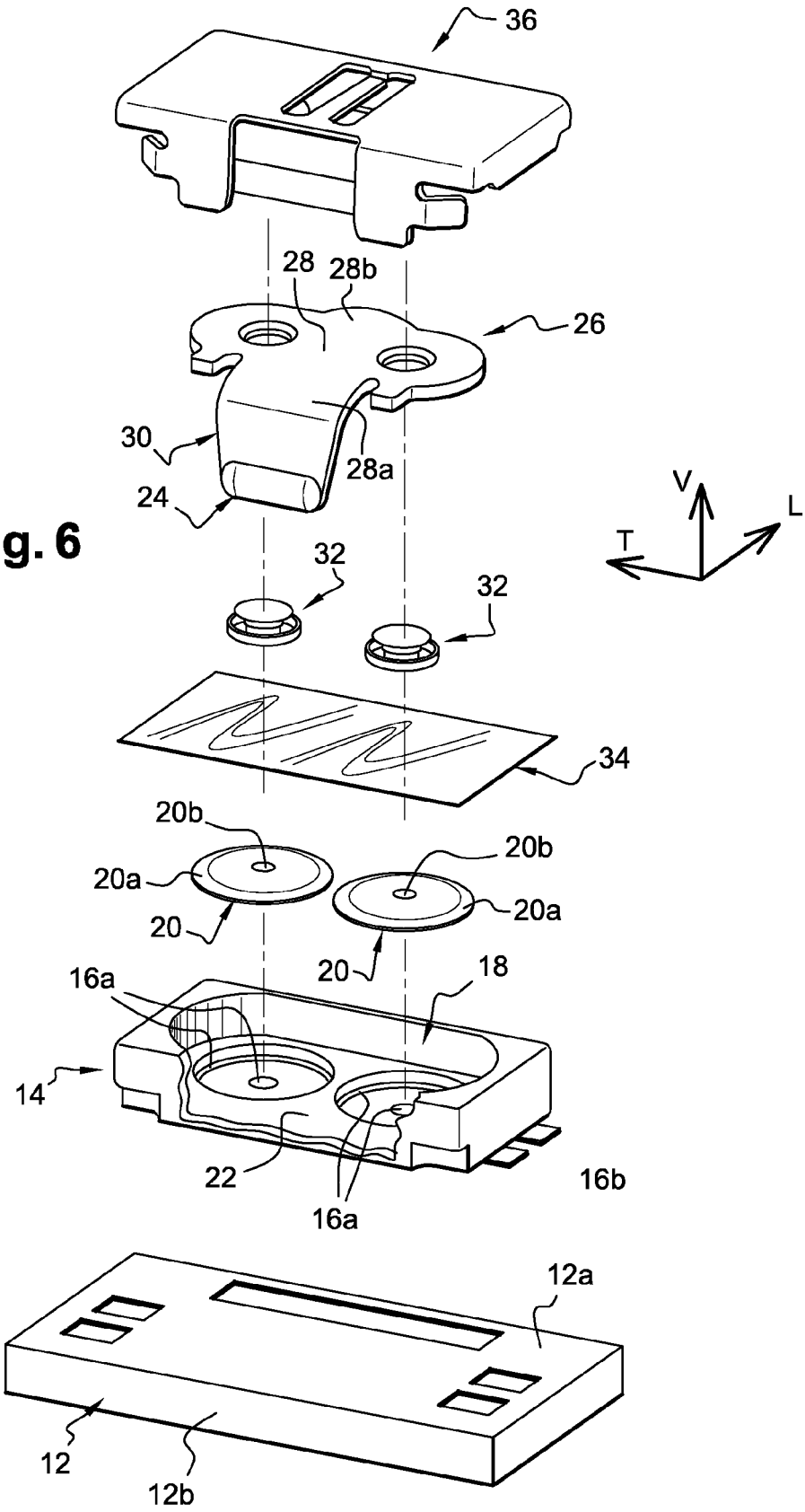
FIG. 6 depicts a schematic exploded perspective representation of an electrical switch comprising two release elements capable of being selectively released depending on the actuation force exerted on the actuation pusher according to an embodiment.

FIG. 6 and following show an embodiment wherein the switch 10 may include two release elements 20 that can be selectively actuated depending on the amplitude of the command action exerted on the pusher 24. The two release elements 20 may be transversely aligned in the recessed housing 18 of the support 14. The upper wing 28 of the lever 26 may be transversely widened and each transverse portion of the upper wing 28 may be positioned above a release element 20 and may bear an actuator 32 associated with a release element 20.

The switch 10 may include two pairs of electrical contacts 16, the first ends 16*a* of which may be associated with a release element in a manner similar to the preceding embodiment, i.e. the first end 16*a* of an electrical contact 16 may form a ring on which the peripheral edge 20*a* of the release element 20 is in permanent contact and the first end 16*a* of the other electrical contact 16 may be positioned at the center of the ring and may be associated with the central portion 20*b* of the release element 20.

In order to be configured to selectively actuate the release elements 20, the lever 26 may be mounted to pivot about a transverse axis A, as previously described, and also about a longitudinal axis B. The two pivot axes A, B of the lever 26 may intersect at the front end 28*a* of the upper wing 28. The front end 28*a* of the upper wing 28 may bulge upwards and may be configured to press upwards at a single point on an associated part of the frame 36 to enable the lever to pivot about the two pivot axes A, B.

The switch 10 may be made symmetrically in relation to a median vertical longitudinal plane. The amplitude of the command action exerted on the pusher may be divided in an identical manner over each release element 20.

In order to have selective actuation of the release elements 20, the mechanical properties of the release elements 20 may be different, such that the threshold value causing the change in state of one release element 20 may be different from the threshold value causing the change in state of the other release element 20.

According to an embodiment, the two release elements 20 may be identical and the geometry of the switch that may be modified. For example, the lever 26 and the housing 18 may be not symmetric relative to the longitudinal rocking axis B of the lever 26, so that the distance between one release element 20 and the longitudinal axis B may be different from the distance between the other release element and the longitudinal axis B.

A first release element 20 may be able to change state when the command action exerted on the pusher is greater than or equal to a first threshold value, and the second release element 20 may be able to change state when the command action exerted on the pusher is greater than or equal to a second threshold value which is greater than the first threshold value.

FIGS. 7A to 9B may represent different states of functioning of the switch 10 according to an embodiment. In FIGS. 7A and 7B, the switch 10 may be represented in the rest position, i.e. no action is being exerted on the pusher 24. The pusher 24 may be in the rest position and at a distance from the edge 12*b* of the component-bearing plate 12. The upper wing 28 of the lever 26 may be horizontal and the rear wing 30 of the lever 26 may be vertical. Moreover, neither of the two release elements 20 may be being actuated.

In FIGS. 8A and 8B, a first command action may be exerted on the pusher 24, the amplitude of this first command action, represented by the arrow F3 in FIG. 8A, may be greater than the first threshold value in order to cause the change in state of a first release element 20, here, the release element 20 the be situated on the left in FIG. 8B. Conversely, the amplitude of this first command action may be less than the second threshold value, so that the second release element 20 does not change state. Since only one release element 20 changes state when this first command action is exerted on the pusher, the lever 26 may rock downwards about the transverse axis A and in a first direction about the longitudinal axis B, here, in the counterclockwise direction with reference to FIG. 8B. Conversely, the pusher 24 may move forward along a path in the longitudinal direction.

In FIGS. 9A and 9B, a second command action may be exerted on the pusher 24. The amplitude of the second command action, represented by the arrow F4 in FIG. 9A, may be greater than the second threshold value, so that the two release elements change state when the user exerts this command action.

When the second command action is applied after the first command action, i.e. starting from the position represented in FIGS. 8A and 8B, the movement of the lever relative to the support 14 may include rocking downwards about the transverse axis A combined with rocking about the longitudinal axis B in a clockwise direction with reference to FIG. 9B.

When the second command action is exerted starting from the rest position represented in FIGS. 7A and 7B, the overall movement of the lever may include rocking about the transverse axis A and the two release elements 20 may be simultaneously actuated. Whatever the position of the switch 10 before the user exerts the second command action, the pusher 24 may move forward along an overall longitudinal path.

In an embodiment, when the user exerts a command action on the pusher 24, the amplitude of the user's action may increase progressively so that when the user exerts the second command action, starting from the rest position, the user may exert the first command action first.

According to an embodiment, and as previously mentioned, each release element 20 may form a releasable stop that may be configured to change state under the effect of the associated command action. The change in state of a release element 20 may be sensed by the user. In an embodiment, when the user exerts the first command action, the user may be informed that this has actually been exerted when the user senses the variations in resistance to his/her action that correspond to the change in state of a release element 20. In the same way, when the user exerts the second command action, the user may be informed that this has actually been exerted when the user senses the variations in resistance to his/her action that correspond to either the successive changes in state of the two release elements 20 or to the change in state of the second release element 20.

In an embodiment, when a large-amplitude action, i.e. one with an amplitude greater than the amplitude of the second command action, is exerted on the pusher, the lever 26 may elastically deform so that the pusher stops longitudinally at the front against the facing edge of the component-bearing plate 12, as represented in FIG. 5.

According to an embodiment, the dimensions of the lever 26 may be defined such that the value of the horizontal force exerted on the pusher 24 is approximately equal to the value of the vertical force exerted on a release element 20. As can be seen in FIG. 3, the longitudinal distance d1 measured between the center of the release element 20 and the transverse hinge axis A is approximately equal to the vertical distance d2 measured between the centre of the pusher and the transverse hinge axis A.

Figure 10:
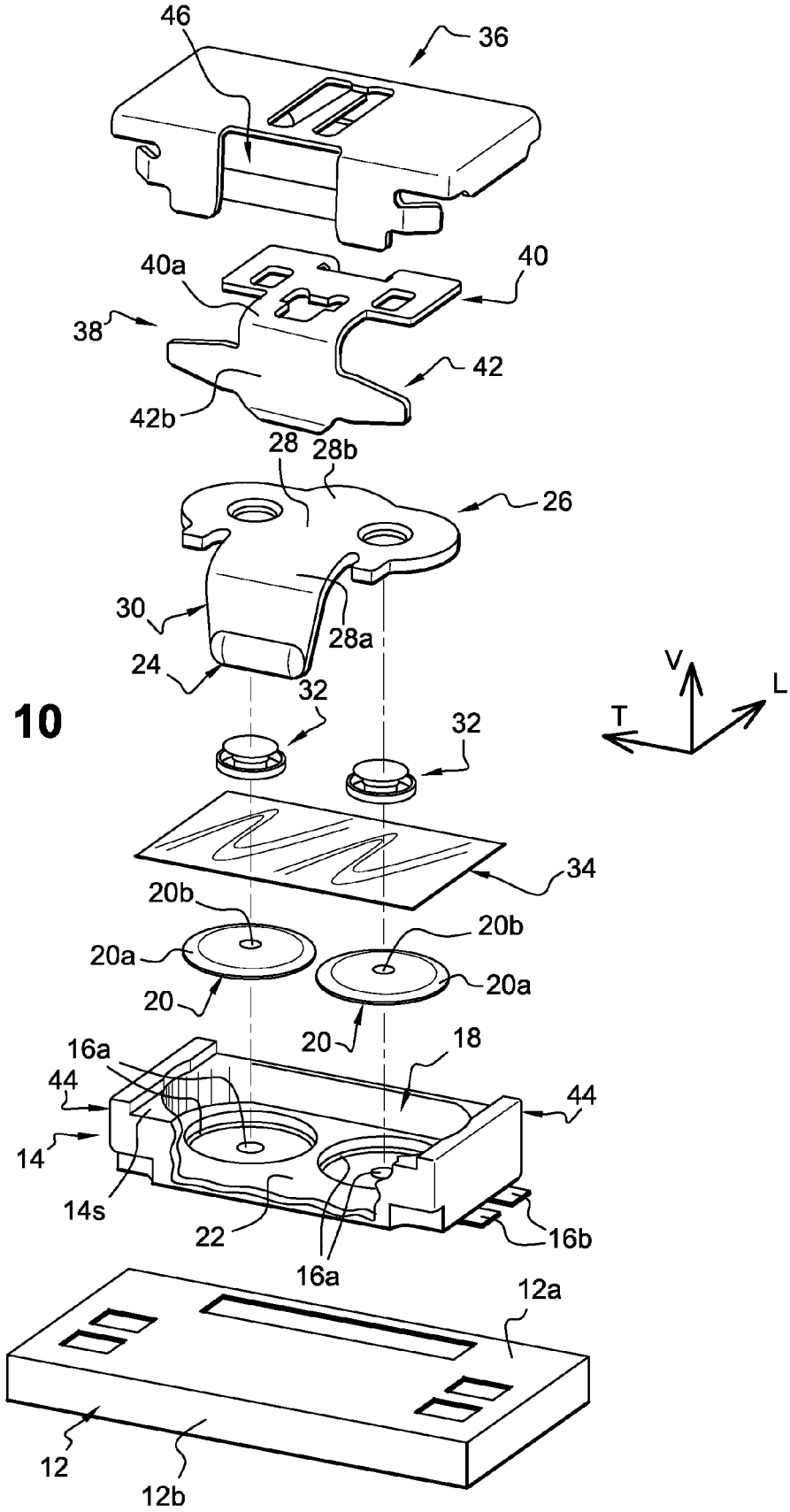
FIG. 10 depicts a view similar to that of FIG. 6 of an electrical switch which comprises a slide according to an embodiment.

FIG. 10 and following represent another embodiment of the switch 10 that may include a slide 38 that is configured to slide longitudinally relative to the support 14 and to the lever 26, when the command action is exerted on the switch 10. The slide 38 may include a plate folded and cut so that its cross section along a vertical longitudinal plane is square in shape.

The slide 38 may include a horizontal body 40 that may be held between the support 14 and the frame 36, and it may include a rear side 42 that may extend vertically downwards in a vertical transverse plane from the rear end 40*a* of the horizontal body 40. The body 40 may be guided, while sliding longitudinally, into a longitudinal housing that may be defined vertically by an upper horizontal face 14*s* of the body 14 and the frame 36, and which may be defined transversely by the walls 44 of the body 14. The transverse width of the rear end 40*a* of the body may be reduced and of a size similar to that of the associated opening 46 in the frame 36 to prevent the body 40 leaving the longitudinal housing.

Figure 11:
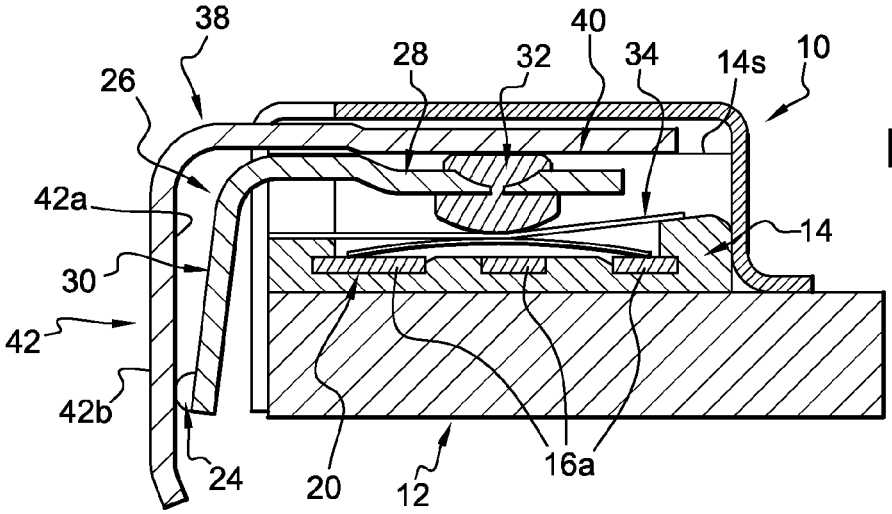
FIG. 11 depicts a cross section through a vertical longitudinal plane of the switch represented in FIG. 10 according to an embodiment.

As can be seen in FIG. 11, the rear side 42 may be positioned longitudinally behind the pusher 24 and the front vertical face 42*a* of the side 42 may press forwards longitudinally on the pusher 24. In order to actuate the switch 10, the user may exert his/her action on the rear face of the side 42 and the side 42 may directly transmit this action to the pusher 24.

Figure 12A:
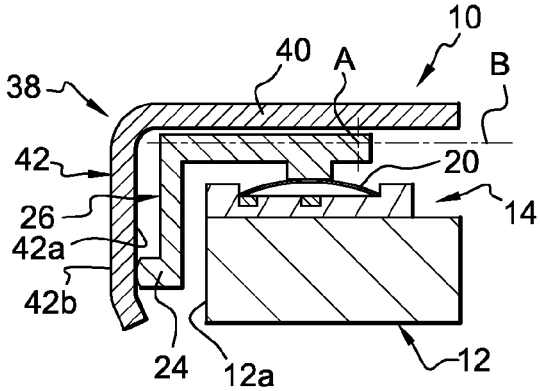
FIGS. 12A, 12B and 12C depict side views of the switch represented in FIG. 10 showing various actuation positions according to an embodiment.
Figure 12B:
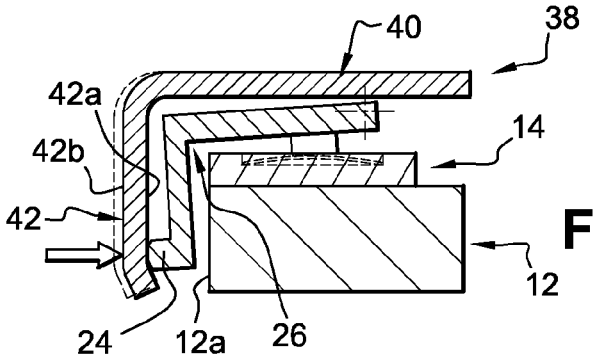
Figure 12C:
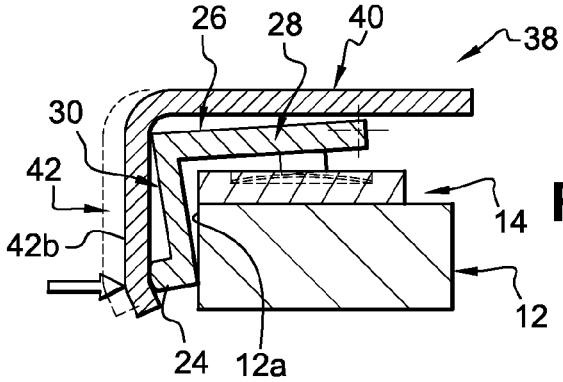

As can be seen in FIGS. 12A to 12C, as the pusher 24 moves overall forwards, the slide 38 may be translated progressively forwards. Thus, as can be seen in FIG. 12*b*, when the user exerts a first command action on the side 42, the lever 26 and the pusher 24 may be rocked about the transverse axis A by a first amplitude, and the slide 38 may be translated forwards by a first distance. Furthermore, the tactile sensation resulting from the change in state of an actuation element 20 may be transmitted to the user by the lever 26, the pusher 24 and the side 42. It may be the same when the user exerts a second command action, resulting in a forward translation of the slide 38 by a greater distance.

As represented in FIG. 12C, when the user exerts a large actuation force on the switch, the lever 26 may be configured to elastically deform to allow the pusher 24 to stop against the rear edge 12*b* of the component-bearing plate 12. The movement of the pusher may include an additional rotation about the rear end 28*a* of the upper wing 28. Conversely, the movement of the slide may include a translation by a still greater distance from the rest position represented in FIG. 12A, relative to the support 14. Thus, whatever the movements of the pusher 24 during the various steps of actuating the switch 10, the slide 38 may undergo movements which may include longitudinal translations from or towards the rest position represented in FIG. 12A.

The user, exerting his command action on the rear face 42*a* of the side 42 of the slide 38, may only feel the translation of the slide and, if need be, the user may feel the tactile sensation resulting from the change in state of one or the other of the release elements 20. This enables improved user comfort in relation to the preceding embodiments for which the user may feel the various movements of the pusher 24, which include rocking movements about the transverse A or longitudinal B axes.

The switch 10 and the component-bearing plate 12 may be designed to be mounted in the casing of an electronic device, close to a wall of the casing, and the actuation of the switch 10 may be carried out by an actuation button that may be mounted so as to slide longitudinally relative to the wall. The fact that the switch 10 may include the slide 38 allows the interface between the switch 10 and the actuation button to be made simpler, as there may be no vertical or transverse displacement of the slide 38 relative to the actuation button when the user exerts a command action. As the movement of the slide 38 may be identical with the movement of the actuation button, there may be no friction between the rear side 42 of the slide 38 and the actuation pusher, which is particularly advantageous when the actuation button is made of a material having a friction factor.

In addition, the surface of the rear side 42 of the slide 38 may be relatively large in relation to the surface of the pusher 24, which may make the positioning of the switch 10 relative to the push button easier. The switch 10 including a slide 38 may be in association with two release elements 20.

It will be understood that the invention is not limited to this embodiment of the switch 10, which may comprise a different number of release elements 20, in particular a single release element 20, as represented in FIGS. 1 to 5.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrical switch comprising:

a support bearing contacts, wherein the support is configured to be mounted on an upper face of a plate bearing electronic components, and wherein the support defines a housing in a base including at least two fixed electrical contacts;

at least one substantially dome-shaped release element, wherein the release element is configured to be accommodated in the housing of the support and wherein the release element is configured to be elastically deformable from a rest position for establishing an electrical connection between the two fixed contacts;

an actuation pusher configured to be movable relative to the support along a path in a plane of the plate bearing electronic components from a rest position associated with the rest position of the release element to an actuation position of the release element; and a lever that is mounted in a hinged manner relative to the support about an axis and wherein the lever is configured to convert an actuation force exerted on the pusher into a release force applied to the release element, wherein the lever is further configured to be elastically deformable to allow a movement of the pusher beyond the actuation position to a position wherein at least part of the actuation force is not transferred to the release element when a value of the actuation force is greater than a threshold value.

2. The switch of claim 1 wherein the lever is configured to deform elastically to allow a movement of the pusher through to a stop position against a facing edge of the plate bearing electronic components.

3. The switch of claim 1 wherein the release element forms a releasable stop of the lever pivoting about the axis, which is configured to change state when an amplitude of the actuation force is greater than a value.

4. The switch of claim 3 wherein a threshold value of the actuation force causing deformation of the lever is greater than the value causing a change in state of the release element.

5. The switch of claim 1 wherein the switch is configured to be mounted substantially towards a rear edge of the plate, wherein the lever comprises:

a first wing arranged behind the rear edge of the plate, a lower end configured to be connected to the pusher, and a second wing configured to extend from an upper end of the first wing such that it is positioned above the release element, and a front end configured to be hinged in relation to the support about at least one hinge axis.

6. The switch of claim 5 wherein the second wing bears an actuator that presses downwards against the release element.

7. The switch of claim 5 wherein a distance between the actuator and the at least one hinge axis is substantially equal to the vertical distance between the pusher and the at least one hinge axis.

8. The switch of claim 5, further comprising:

two release elements distributed on either side of a median axis of the support, wherein each of the two release elements is associated with two electrical contacts, and the two release elements are configured to be selectively actuated depending on an amplitude of the actuation force exerted on the pusher.

9. The switch of claim 8 wherein the lever is configured to pivot about an axis to enable selective actuation of the two release elements.

10. The switch of claim 1, further comprising:

a slide that is configured to be mounted so as to slide relative to the support and wherein the slide is configured to exert the actuation force on the pusher.

11. An assembly comprising:

a component-bearing plate; and a switch comprising:

a support bearing contacts, wherein the support is configured to be mounted close to a rear edge of the plate, and wherein the support defines a housing in a base including at least two fixed electrical contacts, at least one substantially dome-shaped release element, wherein the release element is configured to be accommodated in the housing of the support and wherein the release element is configured to be elastically deformable from a rest position for establishing an electrical connection between the two fixed contacts, an actuation pusher configured to be movable relative to the support along a path in a plane of the plate bearing electronic components from a rest position associated with the rest position of the release element to an actuation position of the release element, and a lever that is mounted in a hinged manner relative to the support about an axis, the lever comprising:

a first wing arranged behind the rear edge of the plate, a lower end configured to be connected to the pusher, and a second wing configured to extend from an upper end of the first wing such that it is positioned above the release element, and a front end configured to be hinged in relation to the support about at least one hinge axis, wherein the lever is configured to convert an actuation force exerted on the pusher into a release force applied to the release element, and wherein the lever is further configured to be elastically deformable to allow a movement of the pusher beyond the actuation position to a position wherein at least part of the actuation force is not transferred to the release element when a value of the actuation force is greater than a threshold value.

12. The assembly of claim 11 wherein the second wing bears an actuator that presses downwards against the release element.

13. The assembly of claim 11 wherein a distance between the actuator and the at least one hinge axis is substantially equal to the vertical distance between the pusher and the at least one hinge axis.

14. The assembly of claim 11 wherein the switch further comprises:

two release elements distributed on either side of a median axis of the support, wherein each of the two release elements is associated with two electrical contacts, and the two release elements are configured to be selectively actuated depending on an amplitude of the actuation force exerted on the pusher.

15. The assembly of claim 14 wherein the lever is configured to pivot about an axis to enable selective actuation of the two release elements.

16. The assembly of claim 11, further comprising:

a slide that is configured to be mounted so as to slide relative to the support and wherein the slide is configured to exert the actuation force on the pusher.

* * * * *